US007576275B2

(12) United States Patent
Dixson, Jr.

(10) Patent No.: US 7,576,275 B2
(45) Date of Patent: Aug. 18, 2009

(54) DRUM LIFT

(76) Inventor: Arthur E. Dixson, Jr., 357 Taulman Rd., Orange, CT (US) 06477

( * ) Notice: Subject to any disclaimer, the term of this patent is extended or adjusted under 35 U.S.C. 154(b) by 0 days.

(21) Appl. No.: 11/805,922

(22) Filed: May 25, 2007

(65) Prior Publication Data

US 2008/0289476 A1 Nov. 27, 2008

(51) Int. Cl.
*G10D 13/02* (2006.01)

(52) U.S. Cl. ..... 84/421

(58) Field of Classification Search ..... 84/411 R, 84/421

See application file for complete search history.

(56) References Cited

U.S. PATENT DOCUMENTS 5,977,464 A * 11/1999 Bencomo, Jr. ..... 84/421
2006/0005689 A1* 1/2006 Ito ..... 84/422.1

* cited by examiner

*Primary Examiner*—Kimberly R Lockett
(74) *Attorney, Agent, or Firm*—Raymond A. Nuzzo

(57) ABSTRACT

A drum lift is configured so as to support a drum and position the drum such that the desired portion of the drumhead is at a desired height and allow a drum pedal assembly to be removably attached to a desired portion of the drum lift so that (1) the hammer or beater strikes the drum at a desired location of the drumhead, and/or (2) the hammer travels a desired rotational distance in order to strike the drumhead. The drum lift comprises a body portion having a base portion, a front wall, a rear wall, a pair of sides, a bottom side for placement on a surface, and a top side. The top side has a concave surface for receiving an outer, curved portion of a drum. Each side of the body portion has a generally vertical portion and an angulated portion that is contiguous with the generally vertical portion and the top side. The drum lift has a generally horizontal plate portion attached to the front wall of the body portion for removably attaching thereto a drum pedal assembly.

9 Claims, 5 Drawing Sheets

DRUM LIFT

BACKGROUND OF THE INVENTION

1. Field of the Invention

The present invention generally relates to a drum lift that supports a drum and allows for a drum pedal assembly to be attached to a desired location on the drum lift so that the hammer of the drum pedal assembly strikes the drumhead at a desired location.

2. Description of Related Art

Bass drums are known in the art and are widely used by musicians all over the world. Bass drums are typically used with foot pedal assemblies which comprise a hammer or beater that strikes the drumhead of the bass drum when a user depresses a foot pedal. Typically foot-operated pedals for use with bass drums are disclosed in U.S. Pat. No. 5,565,637, entitled "Foot Pedal For A Drum", issued to Shigenaga, and U.S. Pat. No. 4,567,808, entitled "Foot Operated Bass Drum Pedal", issued to Smith. It is imperative that the bass drum is in the correct or desired position so the hammer strikes the drumhead at the desired location. Devices have been developed to position the bass drum in the desired position. One such device is disclosed in U.S. Pat. No. 4,829,874, entitled "Support For Bass Drums" and issued to Hoshino. The '874 patent describes a bass drum support to position the drum beating spot at a desired height, to prevent stress at the connection of the drum to a foot pedal operated drum beater and to minimize transmission of vibrations from the drum body to the support and to the foot pedal. The device described in the '874 patent has several components and parts, some of which may need to be adjusted in order to orient the drum in a desired position. Specifically, the drum support of the '874 patent uses a front leg extending beneath the drum toward the surface above which the drum is supported, and a rear support toward the rear end of the drum body for providing support for the rear end of the drum body. The rear support uses first and second legs supported by the surface above which the drum is supported at an angle to enable the rear legs to contact the drum body for raising the drum body off the surface. The front and rear legs are adjustable in height for adjusting the angle of tilt orientation of the drum axis and the height of the drum body.

What is needed is a new and improved drum support device that is easy to use, can be quickly set up, and which is inexpensive to manufacture.

SUMMARY OF THE INVENTION

The present invention is directed to a drum lift. The drum lift is configured to support a drum and position the drum so that the desired portion of the drumhead is at a desired height. The drum lift is also configured to allow a drum pedal assembly to be removably attached to the drum lift at a desired location on the drum lift so that (1) the hammer or beater strikes the drum at a desired location of the drumhead, and/or (2) the hammer travels a desired rotational distance in order to strike the drumhead. The drum lift comprises a body portion having a base portion, a front wall, a rear wall, a pair of sides, a bottom side for placement on a surface, and a top side having a concave surface for receiving an outer, curved portion of a drum. The base portion has a first predetermined length. Each side of the body portion has a generally vertical portion and an angulated portion that is contiguous with the generally vertical portion and the top side. The drum lift further comprises a generally horizontal plate portion attached to the front wall of the body portion. A drum pedal assembly can be removably attached to the generally horizontally plate portion. The generally horizontal plate portion has a second predetermined length that is less than the first predetermined length of the base portion. The generally horizontal plate portion has a front edge, a pair of side edges, a top side and a bottom side. The generally horizontal plate portion further comprises a plurality of ridges on the top side thereof that laterally extend lengthwise between the side edges, and a plurality of ribs on the bottom side. The ribs are adjacent to the front edge of the generally horizontal plate portion and are oriented such that the ribs are generally orthogonal to the direction in which the ridges extend. The generally horizontal plate portion comprises a region to which the drum pedal assembly can be removably attached. The region of the generally horizontal plate portion comprises the front edge, a portion of each side edge, the portion of the top side having the ridges, and the portion of the bottom side having the ribs. The top side of the generally horizontal plate portion further comprises a recessed area upon which a logo or name may be imprinted.

Further features and advantages of the present invention will appear herein below.

BRIEF DESCRIPTION OF THE DRAWINGS

The present invention will be more readily understandable from a consideration of the accompanying drawings, wherein.

DETAILED DESCRIPTION OF PREFERRED EMBODIMENTS

Figure 1:
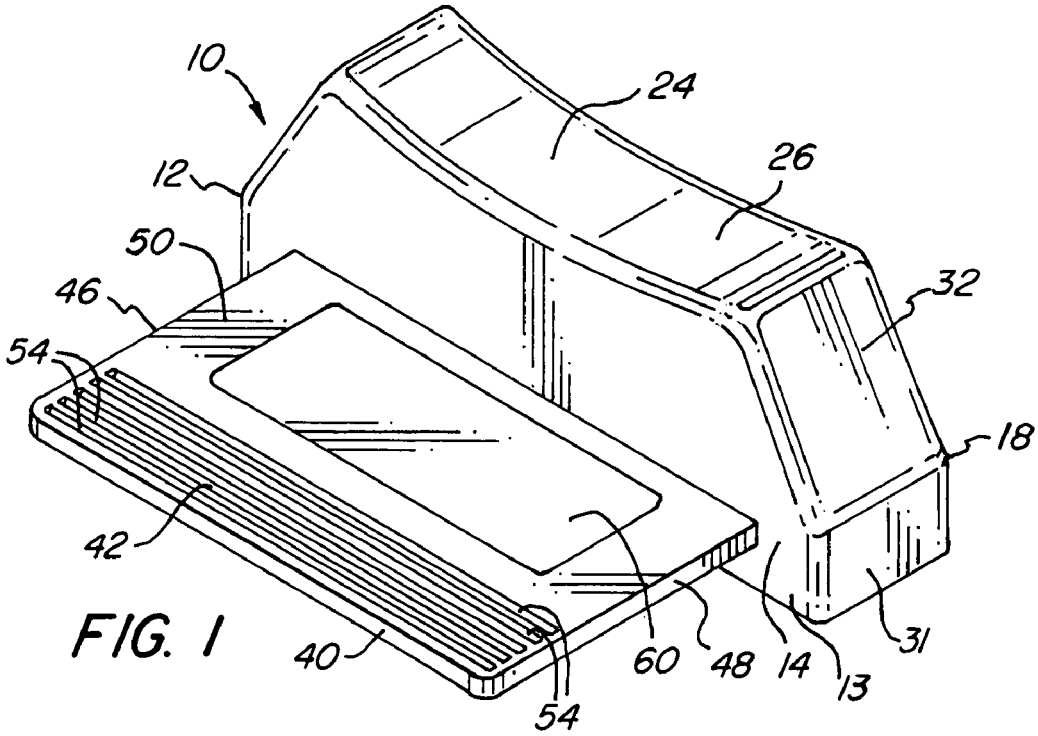
FIG. 1 is a perspective view of the drum lift of the present invention.
Figure 2:
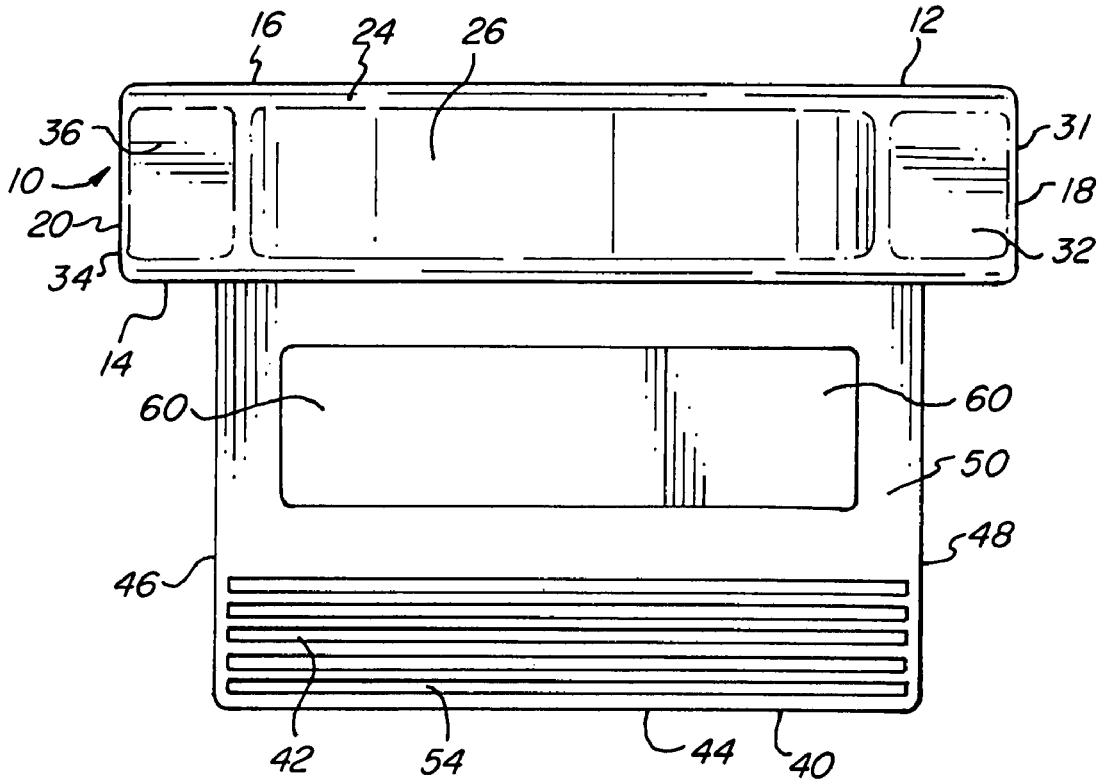
FIG. 2 is a top view of the drum lift of FIG. 1.
Figure 4:
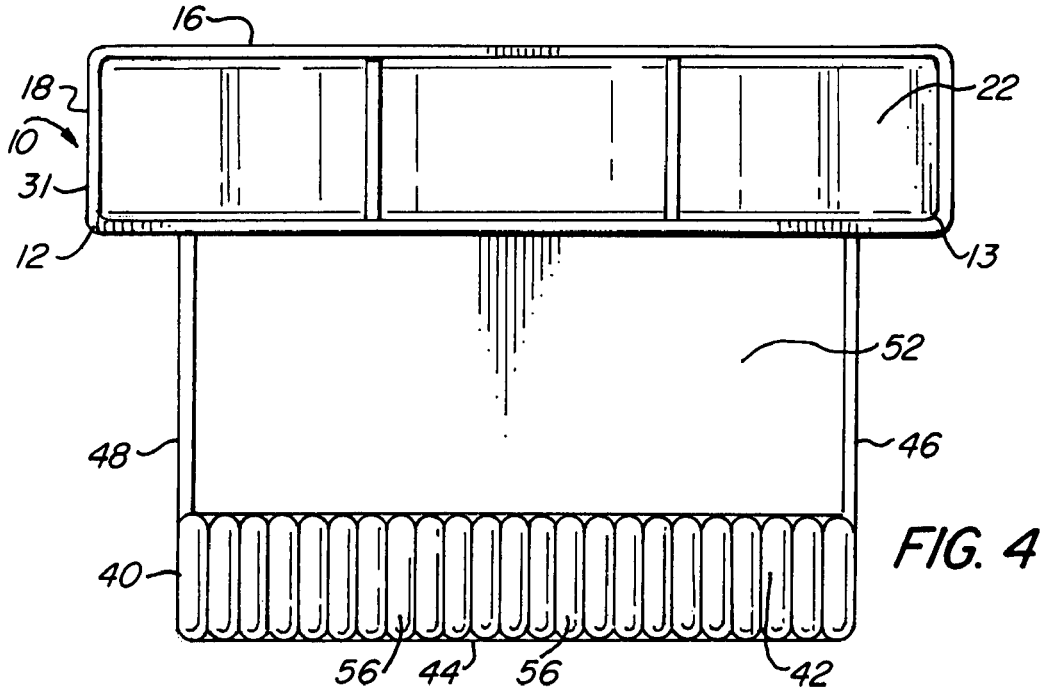
FIG. 4 is a bottom view of the drum lift.
Figure 5:
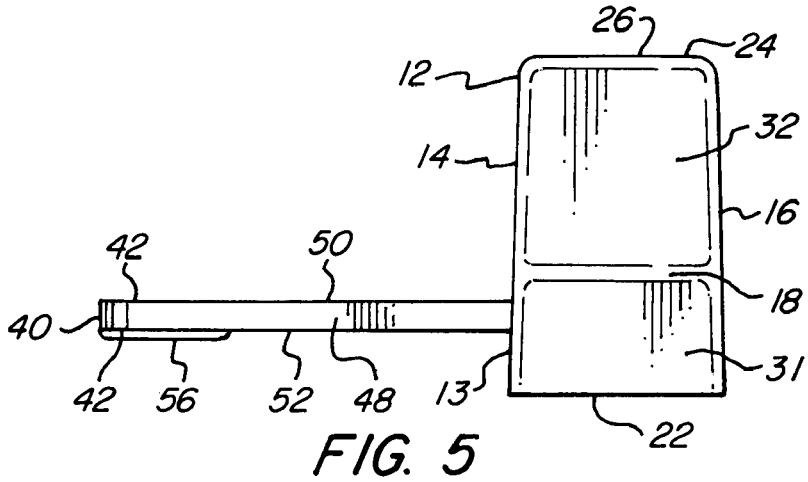
FIG. 5 is a side view of the drum lift.

Referring to FIGS. 1, 2 and 4, there is shown drum lift 10 of the present invention. Drum lift 10 comprises body portion 12 having lower base portion 13, front wall 14, rear wall 16, a pair of sides 18 and 20, bottom side 22 for placement on a surface, and top side 24. Top side 24 is configured to have a concave surface 26. Base portion 13 has a first predetermined length L1. Side 18 comprises generally vertical portion 31 and an angulated portion 32 that is contiguous with generally vertical portion 31 and top portion 24. Side 20 comprises generally vertical portion 34 and an angulated portion 36 that is contiguous with generally vertical portion 34 and top side 24.

Figure 3:
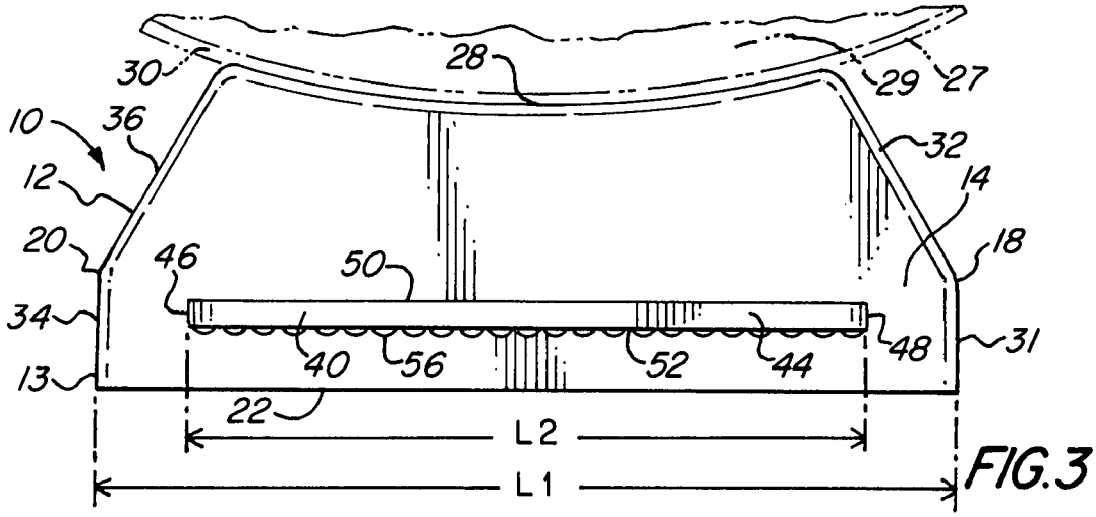
FIG. 3 is a front view of the drum lift, the view showing a portion of a drum positioned on the top side on the drum lift.

Referring to FIG. 3, drum lift 10 is configured to be used with drum 27 which is shown in phantom. Drum 27 has an outer, curved portion or surface 28, drumhead 29 and rim or hoop 30. Concave surface 26 of top side 24 has a curvature that substantially conforms to the outer, curved portion 28 of drum 27.

Referring to FIGS. 1-4, drum lift 10 further comprises generally horizontal plate portion 40 attached to front wall 14 of body portion 12. Generally horizontal plate portion 40 has region 42 to which a drum pedal apparatus may be removably attached. Region 42 is discussed in detail in the ensuing description. Generally horizontal plate portion 40 comprises front edge 44, a pair of side edges 46 and 48, top side 50 and bottom side 52. Generally horizontal plate portion 40 further comprises a plurality of ridges 54 on top side 50. Ridges 54 extend laterally between side edges 46 and 48. Generally horizontal plate portion 40 further comprises a plurality of ribs 56 that are on bottom side 52 and adjacent to front edge 44. Ribs 56 are oriented such that they are generally orthogonal to the direction in which ridges 54 extend. Region 42 comprises front edge 44, the portion of top side 50 having ridges 54 and the portion of bottom side 52 having ribs 56. Generally horizontal plate portion 40 has a predetermined length L2 that is less than the predetermined length L1 of base portion 13. Top side 50 has recessed area 60. In a preferred embodiment, recessed area 60 is substantially smooth. A name, logo or trademark may be imprinted or engraved on recessed area 60. In the alternative, a label having a name, logo or trademark can be applied to recessed area 60.

Drum lift 10 can be fabricated from a variety of materials. For example, drum lift 10 may be fabricated from glass-filled nylon, ABS plastic and polycarbonate. Drum lift 10 may also be fabricated from metal, wood, resin, rubber, etc. In one embodiment, drum lift 10 is fabricated from material that absorbs or dampens vibrations emanating from drum 27.

Figure 6:
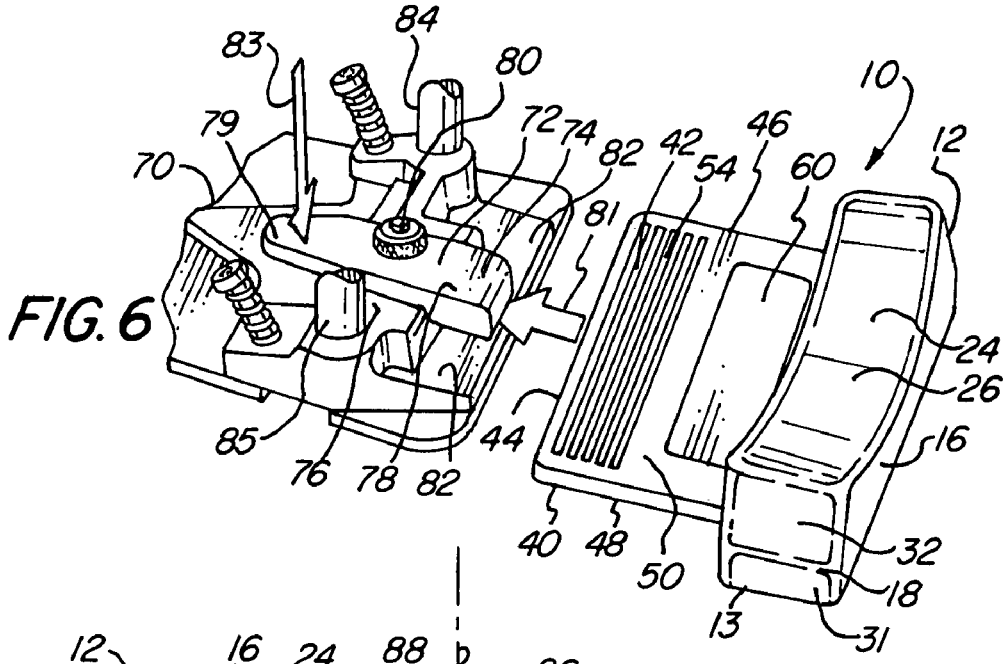
FIG. 6 is an exploded view, in perspective view, showing how a drum pedal apparatus is removably attached to the drum lift.
Figure 7:
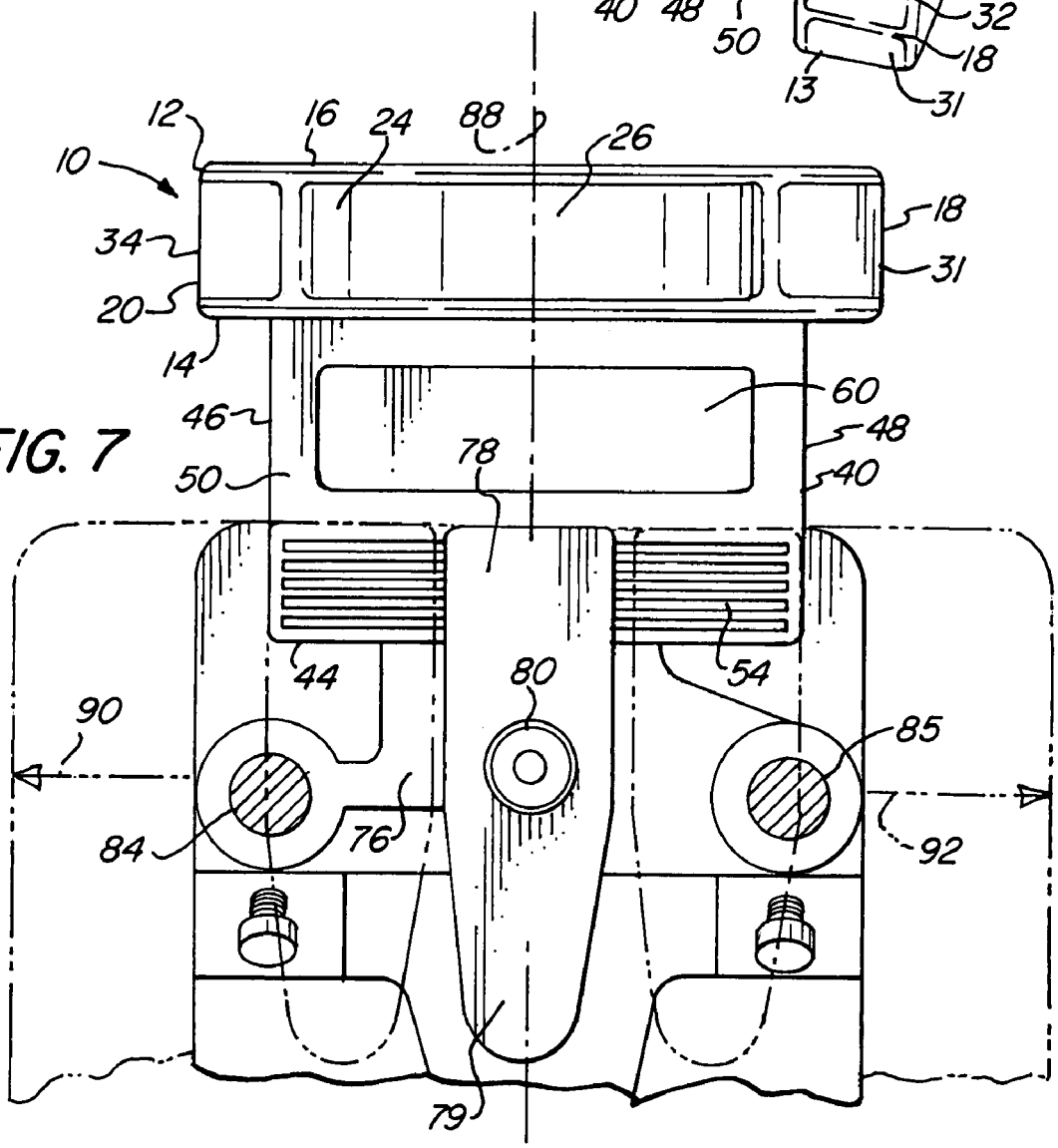
FIG. 7 is a top view showing the drum pedal assembly removably attached to the drum lift, the view also showing in phantom the possible alternate positions on the drum lift to which the drum pedal apparatus can be attached.

Referring to FIGS. 6 and 7, in accordance with the invention, drum lift 10 is used with drum pedal apparatus 70. Drum pedal apparatus 70 is well known in the art and therefore, not all of its components are discussed in detail. Drum pedal apparatus 70 comprises pedal 71, clamp device 72 that has clamp 74. Clamp 74 is adjustably attached to center portion 76 of clamp device 72. Clamp 74 has forward end portion 78 and rearward end portion 79. In order to removably connect drum pedal apparatus 70 to drum lift 10, a user positions drum lift 10 so that generally horizontally plate portion 40 confronts clamp device 72. Next, the user slides generally horizontally plate portion 40, as indicated by arrow 81 in FIG. 6, under clamp 74 so that region 42 of generally horizontally plate portion 40 is between surface 82 of drum pedal apparatus 70 and forward end portion 78 of clamp 74. The user then presses down on rearward end portion 79, as indicated by arrow 83 as shown in FIG. 6, so as to increase the space between surface 82 and the forward end 78. Once region 42 of generally horizontally plate portion 40 is positioned between forward end 78 of clamp 74 and surface 82, the user then tightens nut 84 so that the bottom surface of clamp 74 firmly contacts ridges 54, and ribs 56 firmly contact surface 82. Ridges 54 provide a frictional surface for clamp 74. Similarly, ribs 56 provide a frictional relationship between surface 82 and bottom side 52 of generally horizontal plate portion 40. Thus, ridges 54 and ribs 56 substantially eliminate any movement of drum lift 10 with respect to pedal apparatus 70 and vice-verse while a user is using drum pedal apparatus 70.

Referring to FIGS. 3, 6-9, drum pedal apparatus 70 includes upright members 84 and 85, and hammer 86. Hammer 86 is rotatably connected to upright members 84 and 85. When drum pedal apparatus 70 is removably attached to drum lift 10, the user may then place drum 28 on top side 24 so that the concave surface 26 contacts a portion of the curved, outer surface 28 of drum 27. Once drum 27 is seated upon concave surface 26, the user may operate pedal apparatus 70 so as to cause hammer 86 to strike drumhead 29.

Figure 8:
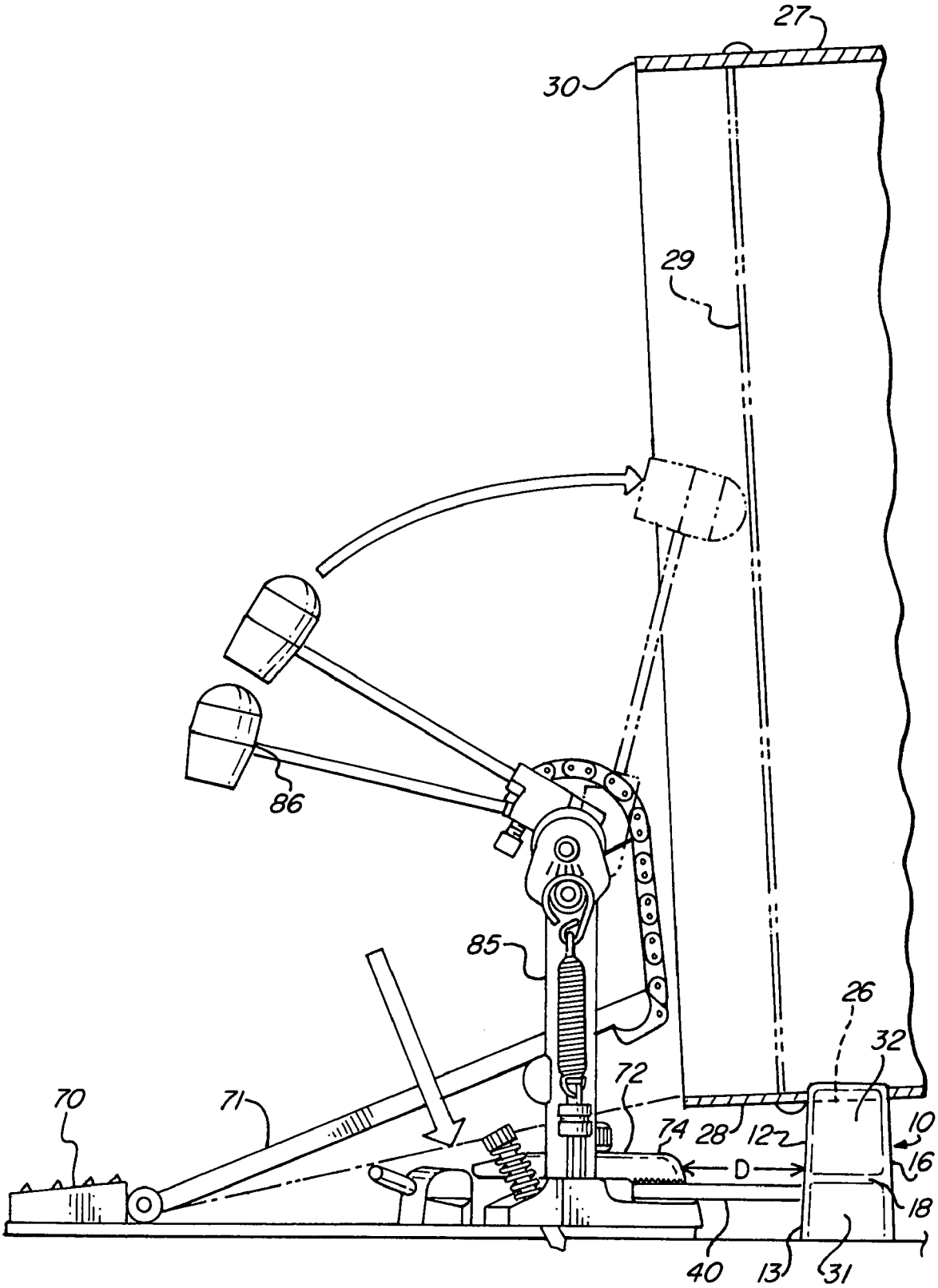
FIG. 8 is a side view, in elevation, showing the drum lift of the present invention with a drum positioned on the drum lift and a drum pedal apparatus removably attached to the generally horizontal plate portion of the drum lift.
Figure 9:
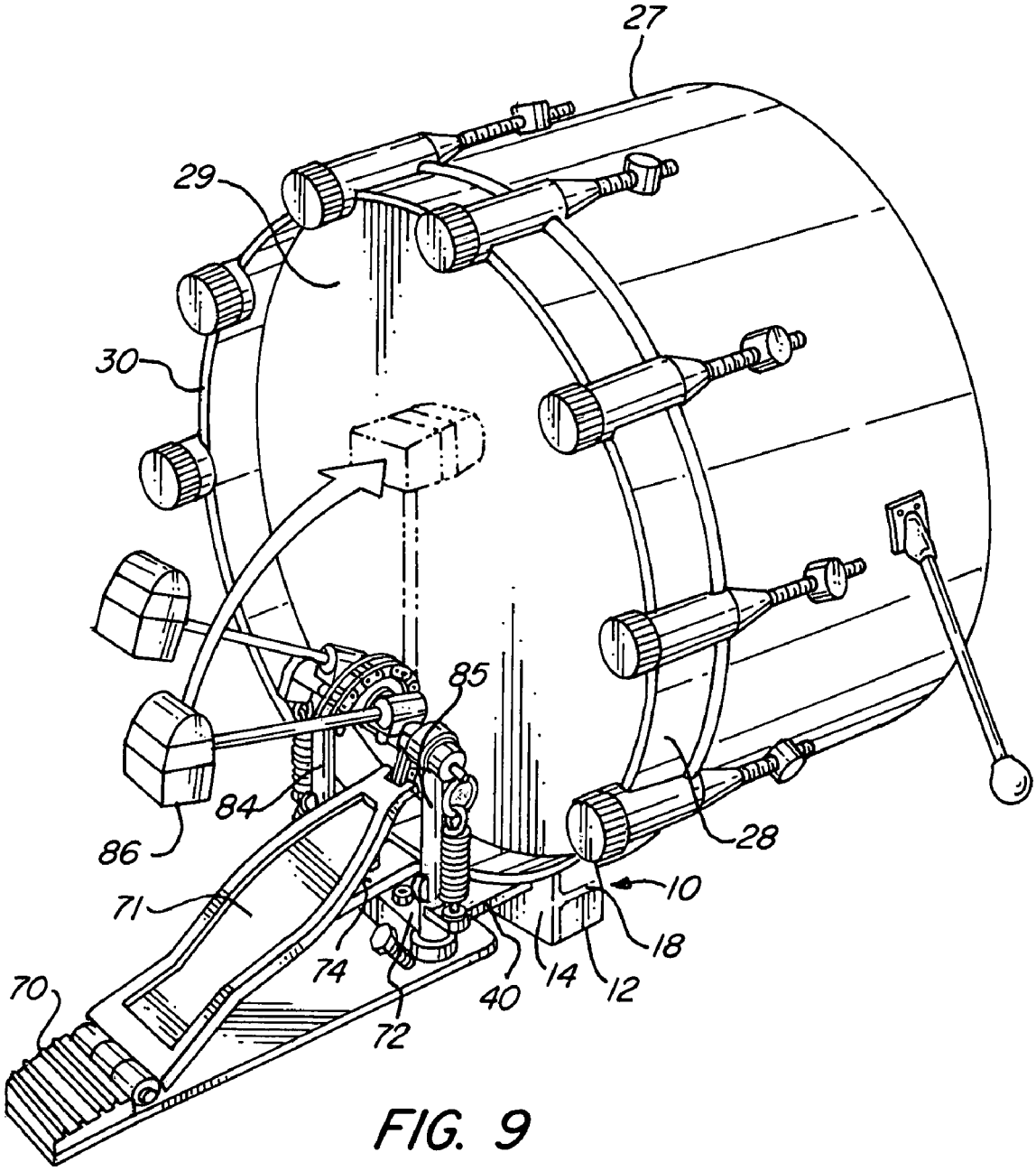
FIG. 9 is a perspective view in elevation, showing the drum lift of the present invention with a drum positioned on the drum lift and a drum pedal apparatus removably attached to the generally horizontal plate portion of the drum lift.

Referring to FIG. 7, pedal apparatus 70 may be positioned at different locations on region 42 of so that hammer 86 strikes drumhead 29 at various locations of drumhead 29 to produce drumbeats having different tambre or tone color, resonance, pitch, etc. For example, clamp 74 can be loosened so as to allow pedal apparatus 70 to be shifted laterally, with respect to reference center axis 88, in the direction indicated by arrow go and reconnected to a different portion of region 42. This results in hammer 86 striking drumhead 29 at a different location in order to achieve a different sound. Similarly, pedal apparatus 70 can be shifted laterally, with respect to reference center axis 88, in the direction indicated by arrow 92 and reconnected to a different portion of region 42 so as to achieve yet another different sound. Referring to FIG. 8, the size of region 42 also allows for a variation in the distance D between front wall 14 of body portion 12 and clamp device 72. Thus, the distance D can be varied by attaching clamp device 74 at different distances from front wall 14 of body portion 12. Varying the distance D will result in increasing or decreasing the distance hammer 86 rotates prior to striking drumhead 29. Increasing or decreasing the distance hammer 86 rotates will also vary the resulting sound when hammer 86 strikes drumhead 29.

Drum lift 10 provides many advantages. For example, drum lift 10 allows a user to position the drum so that hammer 86 consistently strikes drumhead 29 at a desired location. The user may attach drum pedal apparatus 70 to different locations of region 42 so that hammer 86 strikes the drumhead at different locations in order to achieve different sounding drumbeats. Drum pedal apparatus 70 may be connected at various distances from the front wall 14 of body portion 12 so as to vary the rotational distance hammer 86 must travel to strike drumhead 29. Another advantage is that rim or hoop 30 of drum 27 is protected since the drum pedal apparatus 70 is connected to generally horizontal plate portion 40, and not rim or hoop 30. This prevents scratching and damage to rim or hoop 30. Drum lift 10 is light in weight, portable, and can be fabricated from a variety of materials in an efficient and economic manner. Drum lift 10 also substantially reduces the transmission of vibrations from drum 27 to drum pedal apparatus 70.

It is to be understood that the invention is not limited to the illustrations described and shown herein, which are deemed to be merely illustrative of the best modes of carrying out the invention, and which are susceptible of modification of form, size, and arrangement of parts and details of operation. Rather, the invention is intended to encompass all such modifications which are within the spirit and scope as defined by the claims.

What is claimed is:

1. A drum lift for use with a base drum which has a drum shell, a front portion, a spur that extends from the drum shell and is in proximity to the front portion, and a rear portion that is opposite the front portion, the drum lift comprising:

a body portion having a base portion, a front wall, a rear wall, a pair of sides, a bottom side for placement on a surface, and a top side having a single concave surface for receiving a portion of a bass drum shell at the rear portion of the bass drum; and a generally horizontal plate portion rigidly attached to the front wall of the body portion, the generally horizontal plate portion comprising a region to which a drum pedal apparatus can be removably attached, the generally horizontal plate portion having a top side, a bottom side, a front edge and a pair of side edges.

2. The drum lift according to claim 1 wherein the generally horizontal plate portion has a plurality of ridges on the top side thereof, the ridges laterally extending between the pair of side edges.

3. The drum lift according to claim 2 wherein the generally horizontal plate portion further comprises a plurality of ribs on the bottom side thereof, said ribs being adjacent to the front edge and oriented such that the ribs are orthogonal to the direction in which the ridges extend.

4. The drum lift according to claim 3 wherein the region comprises the front edge, the portion of the top side having the plurality of ridges and the portion of the bottom side having the plurality of ribs.

5. The drum lift according to claim 1 wherein the top side of the generally horizontal plate portion includes a recessed area upon which a logo or name may be located.

6. The drum lift according to claim 1 wherein the body portion and generally horizontal plate portion are fabricated from a material that substantially reduces the transmission of vibrations from the drum to the drum pedal assembly.

7. The drum lift according to claim 1 wherein the body portion and generally horizontal plate portion are fabricated from materials chosen from the group consisting of glass-filled nylon, ABS plastic, polycarbonate, resin and rubber.

8. A drum lift comprising:

a body portion having a base portion, a front wall, a rear wall, a pair of sides, a bottom side for placement on a surface, and a top side having a concave surface for receiving an outer, curved portion of a drum, each side of the body portion having a generally vertical portion and an angulated portion that is contiguous with the generally vertical portion and the top side;

a generally horizontal plate portion attached to the front wall of the body portion, the generally horizontal plate portion comprising a region to which a drum pedal apparatus can be removably attached; and said base portion having a first predetermined length and said generally horizontal plate portion having a second predetermined length that is less than the first predetermined length.

9. A drum lift comprising:

a body portion having a base portion, a front wall, a rear wall, a pair of sides, a bottom side for placement on a surface, and a top side having a concave surface for receiving an outer, curved portion of a drum;

a generally horizontal plate portion attached to the front wall of the body portion, the generally horizontal plate portion comprising a region to which a drum pedal apparatus can be removably attached, the generally horizontal plate portion having, a top side, a bottom side, a front edge and a pair of side edges, the generally horizontal plate portion further including a plurality of ridges on the top side thereof wherein the ridges laterally extend between the pair of side edges; and said body portion and said generally horizontal plate portion are fabricated from a material that substantially reduces the transmission of vibrations from the drum to the drum pedal assembly.

* * * * *